United States Patent [19]

Fahey et al.

[11] Patent Number: 4,609,330

[45] Date of Patent: Sep. 2, 1986

[54] MODULAR UNLOADING SEQUENCING SWITCHING VALVE ASSEMBLY FOR HYDRAULIC SYSTEM

[75] Inventors: Daniel T. Fahey, Columbus; William D. Butler, Jr., Powell; Jack Kauffman, Columbus, all of Ohio

[73] Assignee: Federal Supply and Equipment Company, Hilliard, Ohio

[21] Appl. No.: 719,793

[22] Filed: Apr. 4, 1985

[51] Int. Cl.[4] ..... F04B 49/08

[52] U.S. Cl. ..... 417/288

[58] Field of Search ..... 417/286, 287, 288, 303

[56] References Cited

U.S. PATENT DOCUMENTS 1,982,711 12/1934 Vickers ..... 417/287 X 2,905,191 9/1959 Kaay ..... 417/286 X 3,154,921 11/1964 Jank et al. ..... 417/287 X 3,289,688 12/1966 Malott ..... 137/114

*Primary Examiner*—Richard E. Gluck

*Attorney, Agent, or Firm*—Vorys, Sater, Seymour and Pease

[57] ABSTRACT

An improved unloading and sequencing control valve for a two pump hydraulic system is adapted to be mounted directly onto the bearing carrier of a two section gear pump or at a remote location and connected to the pumps by plumbing and is capable of operating in a flow sensing mode only, a pressure sensing mode only, or a combination flow sensing and pressure sensing mode. The control valve includes a removable adjustable flow sensing orifice and is adapted for remote pressure sensing and remote pressure adjustment as well as multiple selective preset flow sensing pressure to provide any desired unloading or sequencing pressure within limits of pump capacity.

31 Claims, 17 Drawing Figures

MODULAR UNLOADING SEQUENCING SWITCHING VALVE ASSEMBLY FOR HYDRAULIC SYSTEM

BACKGROUND OF THE INVENTION

This invention relates to flow regulating valve assemblies for use in connection with hydraulic systems employing a pair of supply pumps, and more particularly to an improved modular unloading and sequencing valve assembly for use in such hydraulic systems.

DESCRIPTION OF THE PRIOR ART

Hydraulic systems of the type employing two fixed displacement supply pumps driven by a common variable speed prime mover for supplying power for other uses are well known and conventionally employed, for example, on vehicles in which the propulsion engine is also employed to drive the pumps. The speed of operation of the pumps and consequently the supply of fluid from each pump varies directly with engine speed. Hydraulic systems of this type may employ pumps of different volumetric capacities, and a valving system is employed to combine the flow of one pump with all or a portion of the flow from the second pump at low speeds, and to divert a portion or all of the output of the second pump above some predetermined output of the first pump. Such valving systems may act as simple unloading valves to divert flow from the second pump back to sump or as a sequencing or switching valve to direct the second pump output to a different hydraulic circuit, sometimes referred to as a power beyond circuit, to be used in operating other apparatus.

The prior art valving devices of this type generally have employed a flow regulating valve connected in the flow line from the second, or secondary pump, with means biasing the valve in a direction to combine the flow of the two pumps and means for applying fluid pressure to shift the valve against the biasing force to divert a progressively increasing amount of the output of the secondary pump as the output of the primary pump increases above some predetermined minimum. For example, Junck et al U.S. Pat. No. 3,154,921 discloses a fluid pressure control system intended for use in hydraulic steering system and in which all or a portion of the output of a high capacity pump flows through a flow restricting orifice to be combined with the flow from a low capacity pump at low speeds, with the pressure drop across the orifice being applied to a spring biased pressure relief valve in a manner to divert flow from the high volume pump back to sump when the pressure differential across the orifice reaches a predetermined level.

Malott U.S. Pat. No. 3,289,688 discloses a flow divider valve for use with a hydraulic system employing two pumps with the valve including a sliding spool valve member which is spring biased in a direction to combine the output of the two pumps at low speed or low pressure levels. The variable flow from the secondary outlet of the valve device may be directed to sump or to a separate pressurized hydraulic circuit.

Fixed displacement gear-type pumps employing two separate pumps on a common shaft mounted in a single housing assembly are available commercially. Such pumps conventionally have a common inlet and may include an internal unloading valve assembly operable to divert all or a portion of the output of one of the pumps back to the pump inlet or to sump above predetermined flow or pressure levels. Such arrangements are not entirely satisfactory, however, in that building the valving assembly into the pump necessarily increases manufacturing cost and can present difficulties in maintenance of the system. For example, when the pump becomes worn and has to be replaced, the entire assembly must be replaced. Also, access to the valving assembly for adjustment or maintenance is difficult and may require dismantling of the complete pump assembly.

Another deficiency of pumps with the unloader built into the pump is that many use short circuit unloading. Instead of diverting the fluid to sump, they internally divert the fluid directly back to the pump inlet. The return line cannot be intercepted for a filter installation, and the fluid from the secondary port is whipped back around the internal loop. No provision can be made to cool or filter the fluid in this loop, as the fluid whips around the internal loop at extremely high velocities. The result is short pump life and high maintenance costs.

In the known prior art flow regulating valve assemblies, various direct and indirect methods are used to control shifting of the flow regulating valve to achieve the unloading function. For example, movement of an axially or rotary movable spool may be controlled by a flow sensing device, or a pressure sensing device, with pressure fluid in the system supplying the force to shift the spool. The various arrangements are not interchangeable in a particular system, however, so that the known valve assemblies may not be readily adaptable to different hydraulic systems. Further, valve systems employing a fixed-sized orifice for detecting or sensing fluid flow may not be reliable in use. For example, when the primary pump loses volumetric efficiency as from wear during service, the output from that pump is reduced and as flow decreases, the flow control valve may not function properly due to an insufficient pressure drop across the fixed orifice.

Also a fixed orifice is sensitive to viscosity changes of the fluid. Seasonal changes, with associated climatic temperature changes, will shift the speed point at which the flow sensing orifice shifts the valve. An adjustable flow sensing orifice allows an operator to optimize performance by simply adjusting the orifice to compensate for changes in fluid viscosity.

In view of the foregoing and other shortcomings of the prior art devices, there exists a need for an improved valve assembly for controlling the unloading and sequencinq or switching of a hydraulic pump in a hydraulic system employing two fluid supply pumps. Accordingly, it is a primary object of the present invention to provide such an improved valve assembly which is both economical to manufacture and reliable in operation.

Another object is to provide such an improved valve assembly of modular construction to enable the assembly to be utilized in various hydraulic systems employing different methods for controlling the regulating valve.

Another object is to provide such an improved valve assembly which is universal in construction and can be mounted directly to a two-gear section pump having a dual outlet bearing carrier to thereby eliminate plumbing between the pump and control valve assembly or alternatively may be mounted at a location spaced from the pumps.

Another object is to provide such a valve assembly which will function in all unloading and power beyond circuits and in which the valve operation is independent of operating pressure levels in the primary or secondary valve outlet ports.

SUMMARY OF THE INVENTION

In the attainment of the foregoing and other objects and advantages, an important feature of the invention resides in providing a flow control valve assembly which will function either as an unloading or a sequencing valve in a two pump hydraulic system and which employs a universal valve body assembly adapted to receive removable modules to adapt the valve assembly to any one of several methods of operation. For example, the valve assembly may be employed in a flow sensing, a pressure sensing, or a flow and pressure sensing mode and may be adapted for remote adjustment and for multiple pressure sensing adjustment. Further, when operating in a flow sensing mode, means are provided for adjusting the flow sensing orifice to compensate for loss in pump volumetric efficiency and thereby maintain the control integrity of the system.

In a preferred embodiment of the invention, the valve assembly includes a monolithic valve body having a system of bores formed therein to define the necessary chambers and fluid passages. Mounting bolt holes and a mounting face are provided to enable the entire assembly to be mounted directly onto the bearing carrier of a two gear section pump with separate fluid inlets communicating with the fluid outlets of the two pump sections.

When the flow control assembly of the present invention is used in a flow sensing mode, an adjustable flow sensing orifice is mounted in the valve body in communication with the primary pump output and the size of the orifice is adjusted to the primary pump drive speed where it is desired that the secondary pump will be fully diverted to the secondary outlet port. The flow sensing orifice is externally adjustable to enable easy and precise control under different operating conditions, to compensate for pump wear, seasonal changes in fluid viscosity, or the like.

When the assembly is operated in a pressure sensing mode, the adjustable flow sensing orifice can be removed and a plug mounted in its opening, and a fixed orifice and pressure sensing relief valve assembly installed in an internal fluid channel leading to one end of the spool valve employed to control diversion of the secondary pump outlet.

When used in a pressure sensing mode, provision may also be made for remote pressure control by use of a remote pressure relief sensing valve, with the remote pressure relief sensing valve being connected to one or more spring relief valves at the control valve assembly whereby one opening pressure level can be set at the pressure sensing relief valve on the control valve and another pressure set at the remote pressure sensing relief valve. Preferably, the remote pressure sensing relief valve can be readily adjusted at the remote location such as in the operator's cab of a vehicle on which the hydraulic system is installed.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENTS

Figure 1:
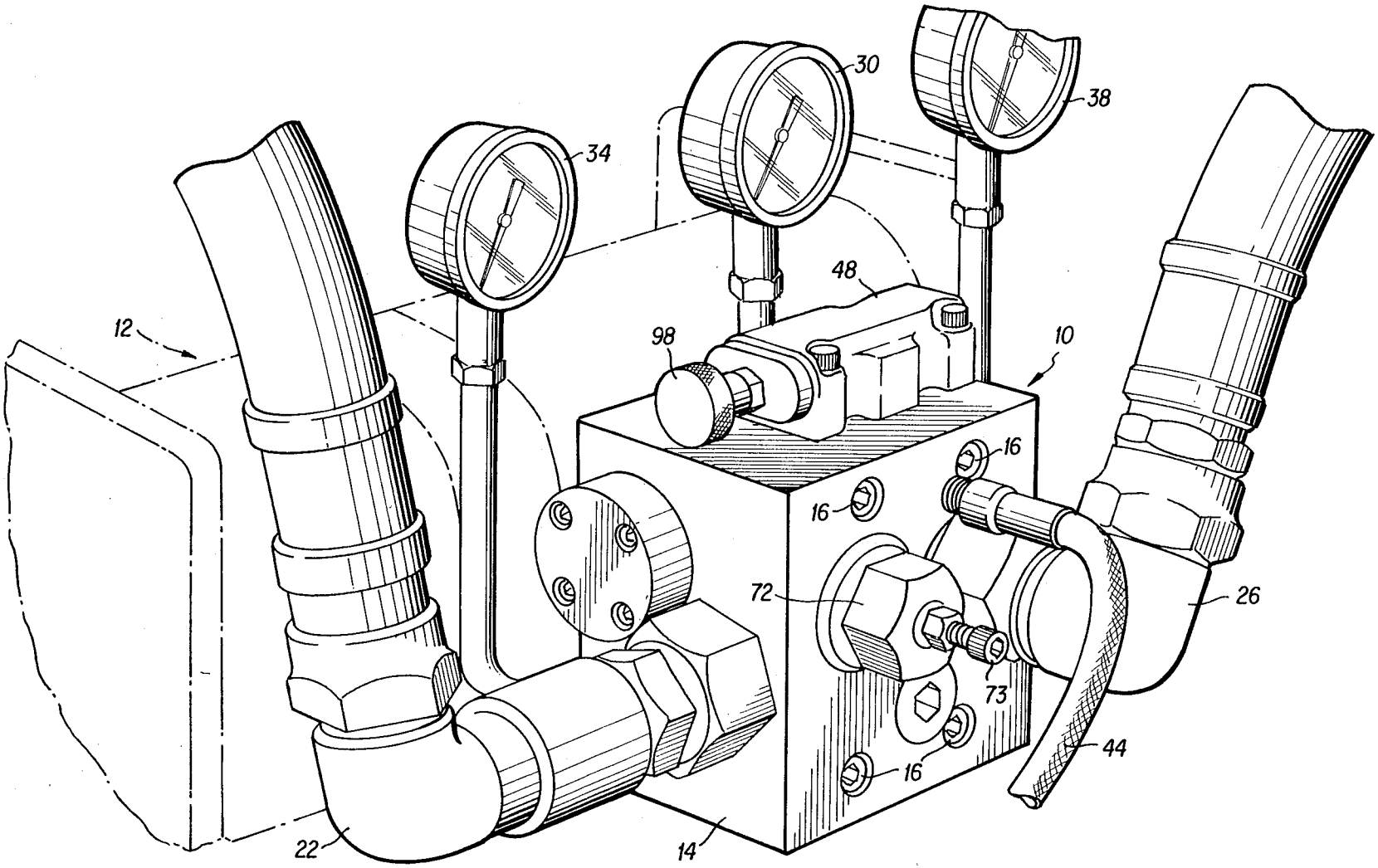
FIG. 1 is an isometric view of a two gear section, fixed-displacement hydraulic pump having the improved unloading and sequencing control valve of the present invention mounted directly thereon.
Figure 2:
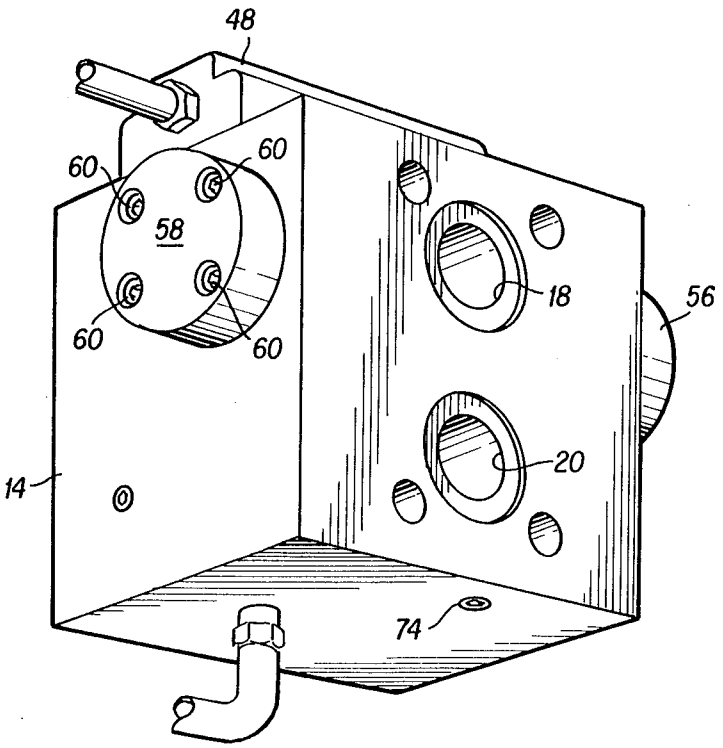
FIG. 2 is an isometric view of the valve assembly shown in FIG. 1, taken from a position substantially diametrically opposite to FIG. 1.

Referring now to the drawings in detail, an unloading and sequencing valve assembly according to the present invention is indicated generally by the reference numeral 10 and illustrated in FIG. 1 as being mounted directly on the dual outlet bearing carrier to a two-gear section pump 12 of the type manufactured by Commercial Shearing, Inc. of Youngstown, Ohio. Valve assembly 10 is shown as including a monolithic valve body 14 mounted directly to the housing of pump 12 by four mounting bolts 16 so that the primary and secondary pressure fluid inlets 18, 20 (FIG. 2) of the valve body communicate one with each pump outlet port of the dual pump 12. As shown in FIG. 1, a pressure fluid hose 22 is connected to the primary valve outlet passage 24 and a similar hose 26 is connected to the secondary valve outlet passage defined by a bore 28 extending into housing 14.

Figure 4:
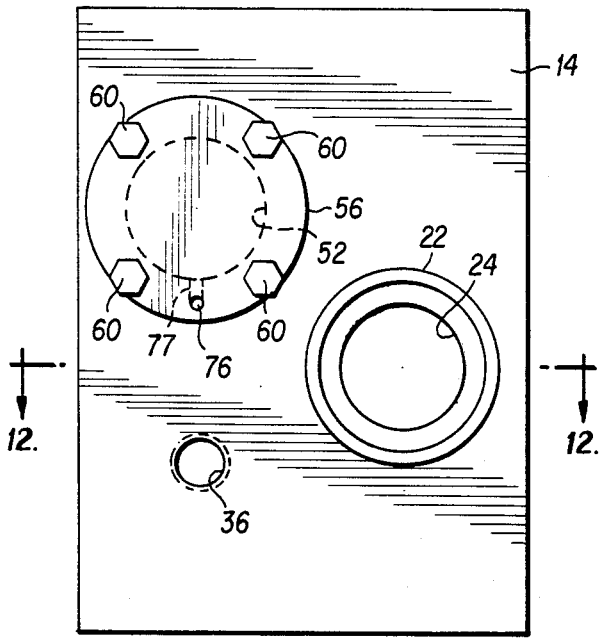
FIG. 4 is an end elevation view showing the left end of the structure shown in FIG. 3.
Figure 5:
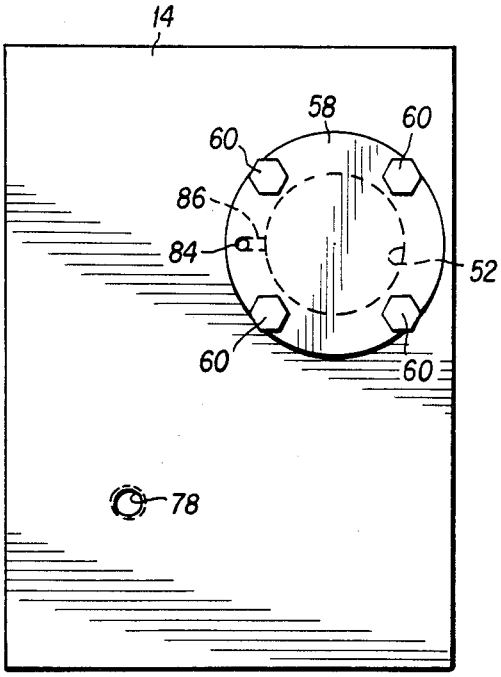
FIG. 5 is a view similar to FIG. 4 and showing the opposite end of the valve assembly.
Figure 6:
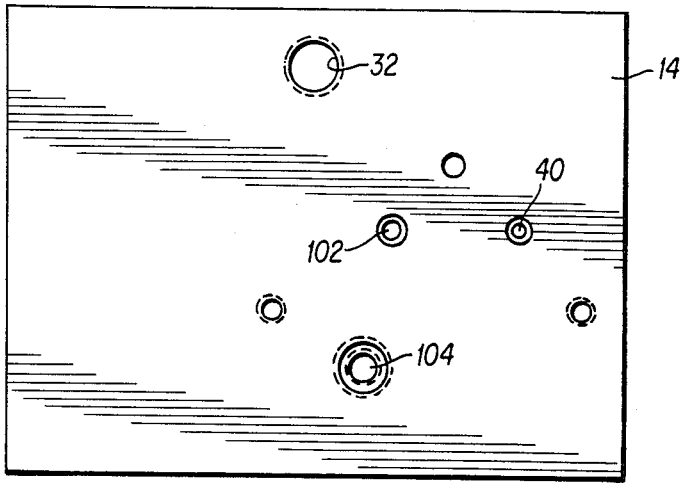
FIG. 6 is a top plan view of the structure shown in FIG. 3.
Figure 7:
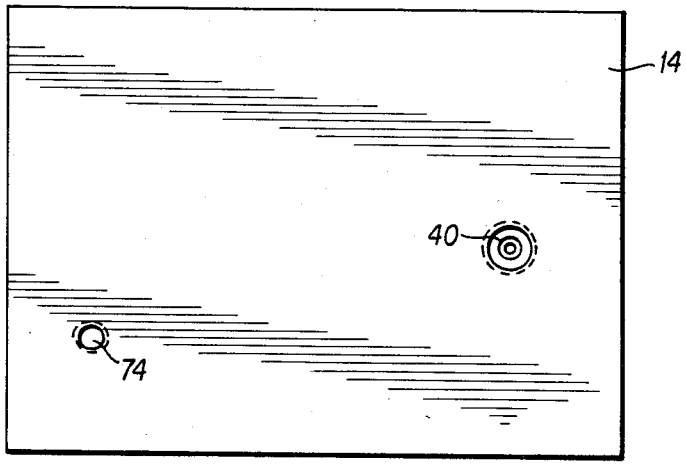
FIG. 7 is a bottom plan view of the structure shown in FIG. 3.
Figure 8:
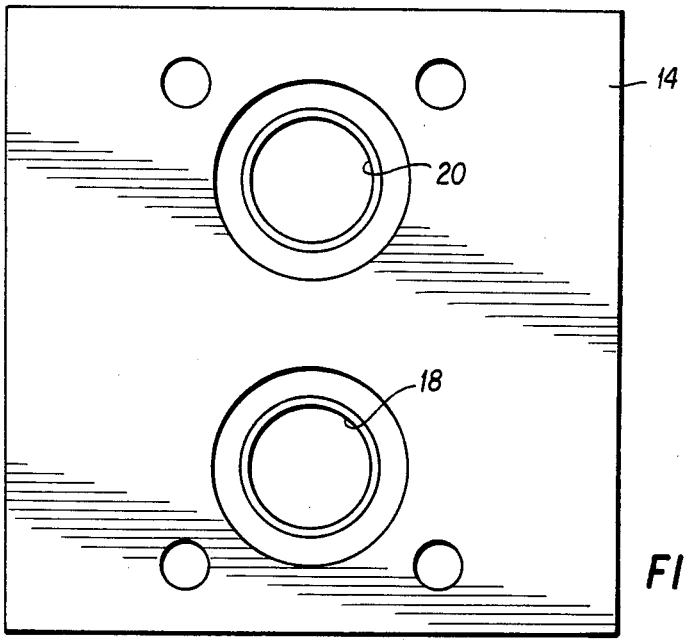
FIG. 8 is a rear elevation view of the valve assembly.

A first pressure gauge 30 is connected in a drilled passage 32 communicating with valve body inlet 20 to continuously indicate secondary inlet pressure ($P_0$) and a second pressure gauge 34 is connected in a drilled passage 36 (see FIG. 4) communicating with the primary inlet 18 to continuously indicate primary pump pressure ($P_1$). A third pressure gauge 38 connected in drilled passage 40 (FIGS. 7 and 11) which communicates with primary outlet 24 to continuously indicate primary valve outlet pressure ($P_2$). It should be understood that any one or more of the gauges 30, 34 or 38 may be omitted, in which case the drilled passage in the valve body leading to the gauge not used would be plugged. An external drain line 44 connected in drilled passage 46 provides drainage to sump from a pressure relief sensing valve assembly 48 mounted, as by bolts 50, on the top surface of valve body 14.

Figure 9:
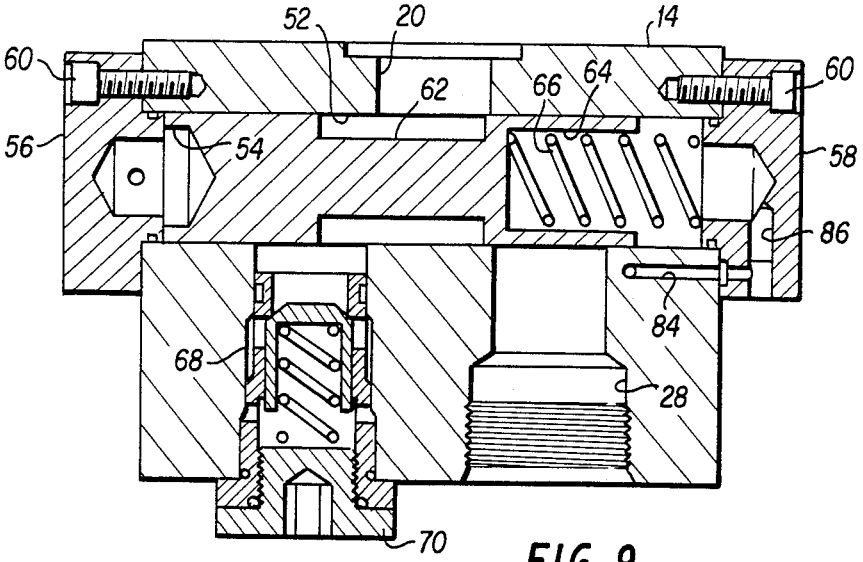
FIG. 9 is a sectional view taken along line 9—9 of FIG. 3.

As best seen in FIG. 9, pressure fluid from the secondary pump is directed through inlet passage 20 into a spool valve chamber 52 defined by an elongated bore extending completely thorugh valve body 14. An axially slidable valve spool 54 is mounted in chamber 52 and retained therein by end caps 56, 58 mounted on the end faces of valve body 14 as by bolts 60. Spool 54 has an annular recess or metering groove 62 formed around its central portion and an axially extending bore 64 formed in one end. A coil spring 66 is mounted in bore 64 and has one end bearing against end cap 58 to continuously bias spool 54 toward end cap 56. The end walls of valve spool 54 cooperate with the walls of chamber 52 and caps 66, 58 to define a pressure chamber at each end of the spool valve. Similarly, groove 62 cooperates with the walls of chamber 52 to define a movable flow chamber located between and isolated from the two pressure chambers.

A large bore or recessed chamber 68 extends generally parallel to outlet 28 and communicates with the spool valve chamber 52, with bores 28 and 68 being spaced apart along the axis of the chamber 52 and located one on each side of the axis of secondary inlet passage 20. A one-way check valve 70 is threadably mounted in bore 68, and primary outlet passage 24 extends at right angles to and communicates with bore 68 downstream of the check valve.

Figure 10:
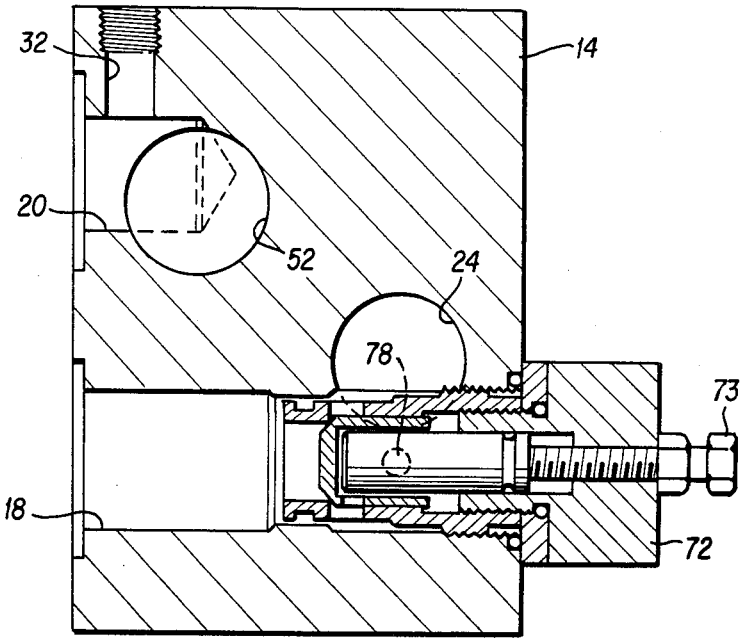
FIG. 10 is a sectional view taken on line 10—10 of FIG. 3.

As best seen in FIGS. 1 and 10, primary inlet 18 is defined by a passage extending completely through valve body 14, and an adjustable flow sensing orifice assembly 72 is threadably mounted in and closes the outwardly directed end of the primary inlet passage 18. Primary outlet passage 24 intersects passage 18 downstream of the adjustable flow orifice of assembly 72, thereby providing a continuous flow passage from the inlet through the adjustable flow sensing orifice 72 to primary outlet hose 22. An externally accessible adjusting screw 73 enables adjustment of the size of the flow restricting orifice in assembly 72.

In the flow sensing mode of operation, fluid pressure from upstream of the adjustable flow sensing orifice ($P_1$) is supplied through a first pilot pressure passage to the pressure chamber opposite the biasing spring 66, and fluid pressure from downstream of the adjustable orifice ($P_2$) is supplied through a second pilot pressure passage to the pressure chamber containing the spring 66. The first pilot pressure passage includes a drilled bore 74 which intersects gauge pressure passage 36 which, in turn, intersects primary inlet passage 18 upstream of the flow sensing orifice and a second drilled bore 76 which intersects bore 74 and terminates in an open end communicating with a passage 77 in end cap 56. $P_2$ pressure supplied to the opposite end of valve spool 54 through the second pilot pressure passage assists biasing spring 66 in urging the valve spool toward end cap 56 to provide a fluid flow passage from inlet 20 around the annular groove 62 and valve spool 54 to bore 68, then through check valve assembly 70 to be combined with primary pump outlet flow in outlet passage 24. The second pilot pressure passage includes a drilled bore 78 providing communication between inlet chamber 18 downstream of the adjustable flow sensing orifice assembly 72 and a filter cavity 80 adapted to threadably receive a removable filter assembly 82 including a filter element downstream of bore 78. Downstream of filter 82, filter cavity 80 communicates with drilled $P_2$ gauge passage 40 which extends completely through valve body 14 and terminates in an open end. A further drilled bore 84 formed in the valve body intersects flow passage 40 and communicates with a drilled passage 86 in end cap 58 to complete the path of $P_2$ pressure to the spring biased end of the spool valve.

Figure 3:
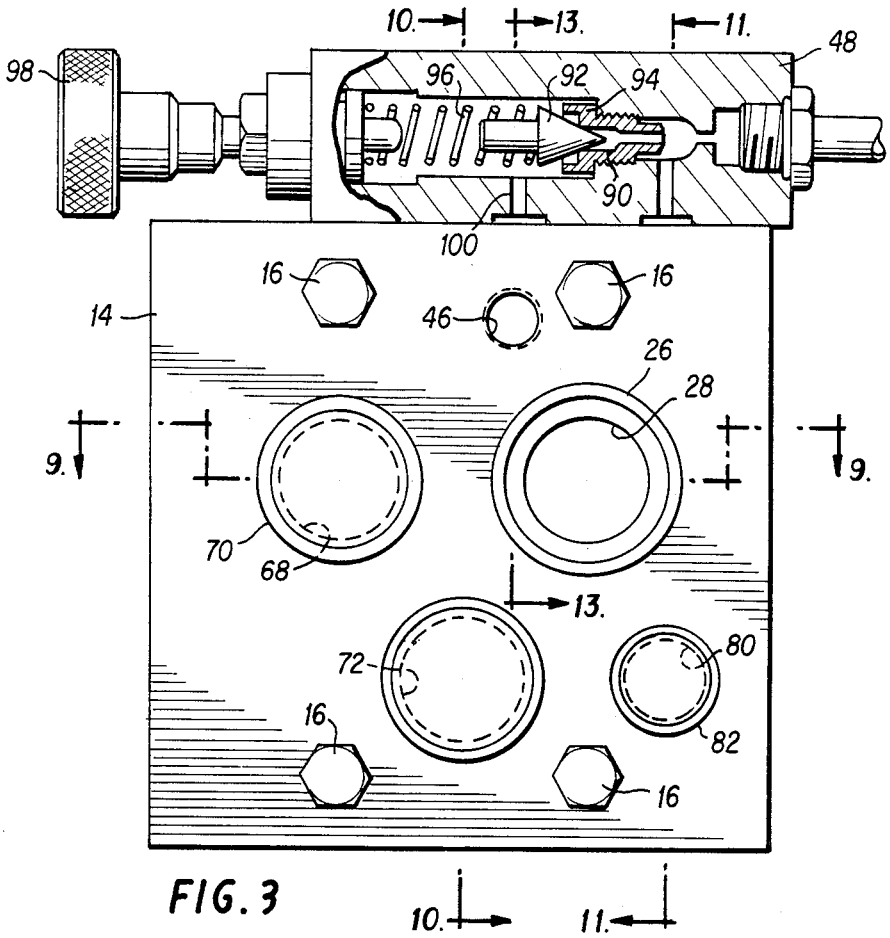
FIG. 3 is a front elevation view of the valve assembly shown in FIG. 1.
Figure 16:
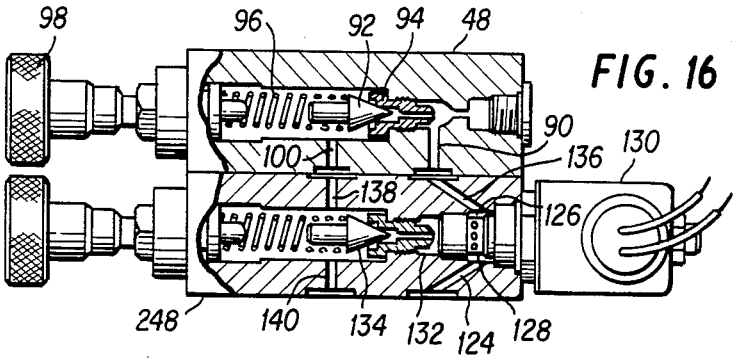
FIG. 16 is a fragmentary sectional view showing a further embodinent of the invention employing multiple pressure sensing with remote control.

The open end of $P_2$ passage 40, i.e., the end opposite the $P_2$ gauge 38, provides $P_2$ pressure to the pressure inlet port 90 of adjustable pressure sensing valve assembly 48. As best seen in FIGS. 3 and 16, valve assembly 48 includes a conical valve member 92 normally urged into seating relation with an annular valve seat 94 by a resilient coil spring 96. A threaded external adjusting knob assembly 98 is provided for selectively adjusting the spring force on valve member 92 and therefore the opening pressure of the relief valve. The relief valve has a drain 100 which communicates with an internal drain bore 102 extending into the top of valve body 14 and terminating in communication with the external drain bore 46.

Pressure relief valve assembly 48 may also be drained internally when the secondary outlet is not pressurized. To accomplish this, a drilled passage 104 is formed in valve body 14 in position to intersect external drain bore 46 and secondary outlet bore 28, and a plug 106 closes the outer end of passage 104. When internal drainage is employed, external drain line 44 is removed and drain passage 46 is plugged. Conversely, when external draining is desired, the secondary outlet 28 may be isolated from the drain by inserting a removable plug (not shown) in the reduced diameter threaded section 106 of passage 104 between external drain bore 46 and secondary outlet bore 28. External draining is required when the assembly is used in a power beyond circuit wherein the secondary outlet hose 26 is pressurized.

Figure 11:
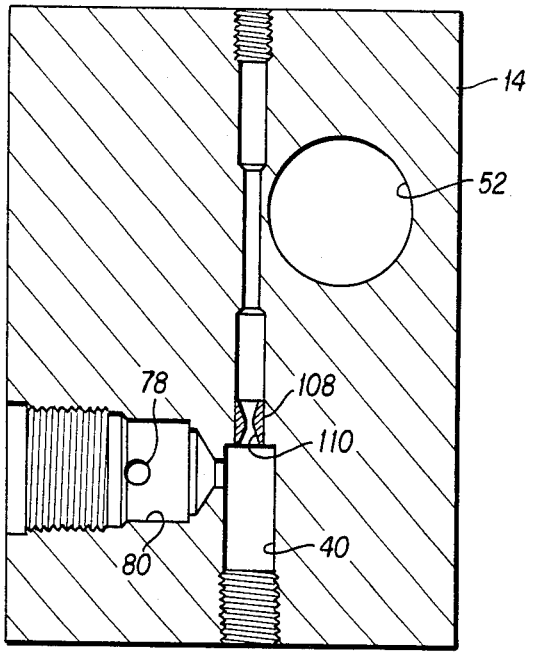
FIG. 11 is a sectional view taken along line 11—11 of FIG. 3.
Figure 12:
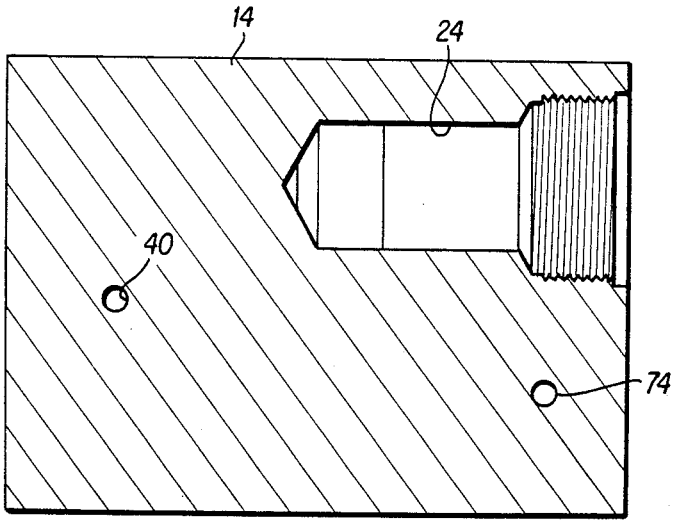
FIG. 12 is a sectional view taken along line 12—12 of FIG. 4.
Figure 13:
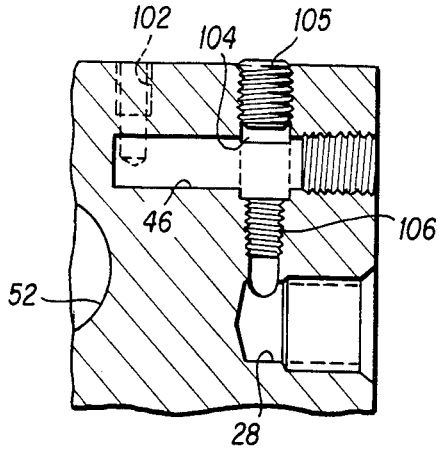
FIG. 13 is a fragmentary sectional view taken along line 13—13 of FIG. 3.

As seen in FIG. 11, passage 40 also has an internally threaded, reduced diameter portion downstream of filter cavity 80 and a removable pipe plug 108 is threaded into this section when the assembly is used in a pressure sensing mode. Plug 108 has a small diameter passage extending therethrough to provide a fixed orifice 110 capable of producing a pressure drop upon flow of fluid through the orifice.

As will be apparent from the above, the unloading and sequencing valve of the present invention may be employed either as a flow sensing or a pressure sensing control valve. When operated in the flow sensing mode, the pressure sensing relief valve 48 functions only as a relief valve and will not interfere with flow sensing operation so long as the opening pressure of valve 48 is set sufficiently high. Also, in this mode, plug 108 is preferably removed.

Figure 14:
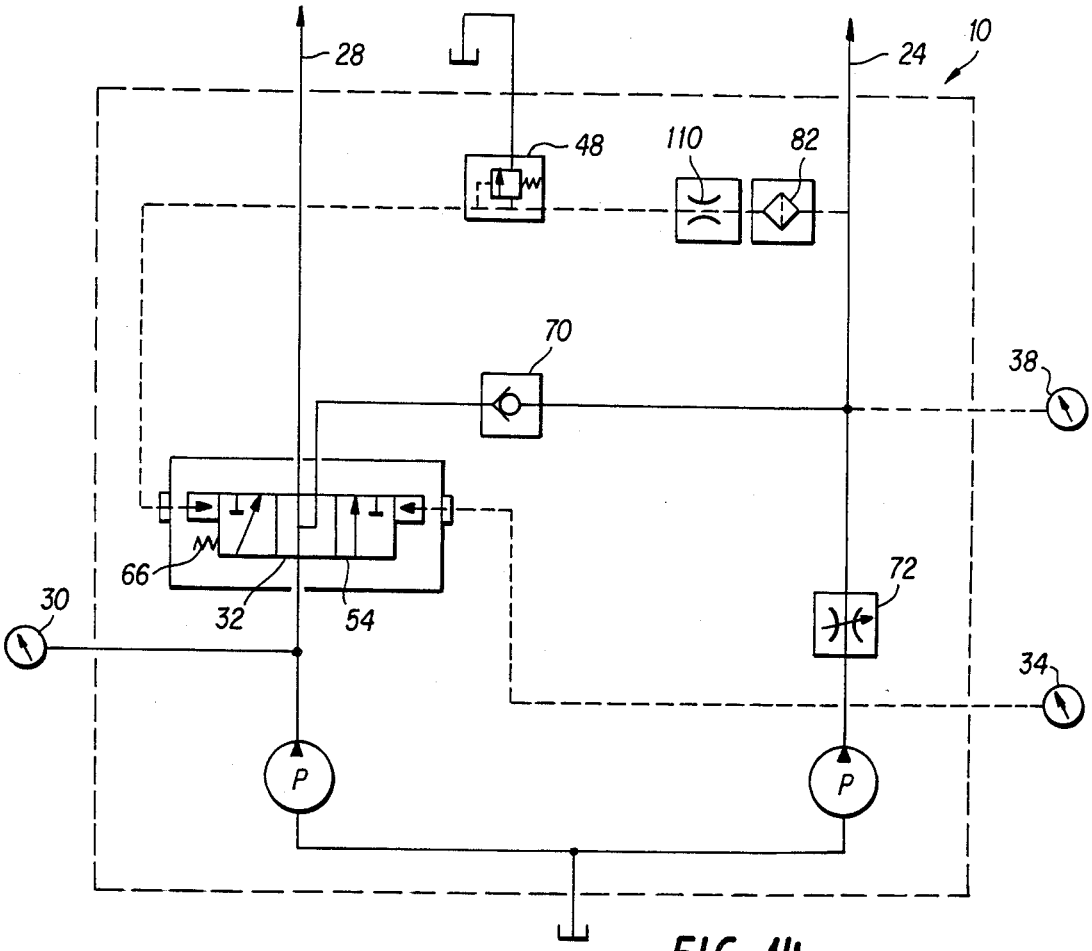
FIG. 14 is a flow schematic of the flow control valve assembly used in connection with two fixed displacement supply pumps.

Referring now to the flow schematic of FIG. 14, when the valve assembly 10 is operated in the flow sensing mode, the adjustable flow sensing orifice 72 is set to produce a pressure drop across the orifice which will result in secondary pump flow being fully diverted to the secondary outlet port at the desired speed, and consequently the desired flow rate, of the primary pump. The total output from the primary pump continuously flows through the orifice assembly 72 and into the primary valve outlet 24, and $P_1$ and $P_2$ pressures are supplied from the upstream and downstream sides respectively, of orifice 72 to the opposite ends of the valve spool 54 as described above. The output from the secondary pump continuously flows into chamber 52 of the spool valve which, at low speed, is biased by the spring 66 to divert all or substantially all of the secondary pump output through check valve 70 to be combined with the primary pump output downstream of the adjustable flow orifice. At such low speeds, pressure drop across the adjustable orifice will be insufficient, when applied to the opposing ends of the spool valve, to shift the valve. As flow increases, however, the pressure differential across the adjustable orifice 72 increases, and the higher $P_1$ pressure applied to the end of the valve spool opposite the spring will start to shift the spool 54 in a direction to divert a portion of the secondary pump output directly into secondary outlet passage 28 to be returned to sump when the system is operated as an unloading valve or to be directed to a power beyond circuit when operated as a sequencing valve. When pressure in the secondary pump outlet ($P_0$) drops below that of $P_2$ pressure, as a result of secondary pump outlet being vented to sump, flow from the primary pump back through the spool valve is prevented by check valve 70. Check valve 70 will also close at any time during operation in a power beyond circuit when $P_0$ is less than the sum of the $P_2$ pressure and the pressure drop across the check valve.

Reducing the speed of the primary pump will, of course, reverse the cycle just described. Thus, since the output of the primary and secondary pumps are directly proportional to drive speed, a decrease in pump speed produces a corresponding decrease in flow and the pressure differential across the adjustable flow sensing orifice 72 decreases until valve spool 54 starts to shift in a direction away from the biasing spring to direct a portion of the secondary pump flow into the primary valve outlet 24. This will continue until the speed is reduced to the point that all flow from both pumps is again discharged from the primary outlet.

To operate the valve assembly in a pressure sensing mode, the adjustable flow sensing orifice assembly 72 is removed and the orifice assembly opening in the housing 14 is closed by a suitable plug whereby primary pump discharge flows unobstructed from the primary valve inlet 18 to the primary outlet hose 22. Also, the fixed orifice plug 108 is installed in passage 40 as described above. Because of the small diameter of the orifice 110 in plug 108, the $P_2$ orifice filter assembly should always be used in conjunction with the fixed orifice to assure against any foreign material obstructing the orifice and interfering with the pressure sensing capability of the system. The pressure sensing relief valve 48 is set to start opening when pressure in the primary outlet reaches the level where it is desired to start diverting secondary flow from the primary outlet. Since the adjustable flow sensing orifice 72 is not used, $P_1$ pressure will be supplied to the filter cavity 80 and to the upstream side of fixed orifice 110.

In this pressure sensing mode of operation, the filter 82, fixed orifice 110, and the pressure sensing relief valve assembly 48 provide the pressure sensing function to control fluid pressure to the spring biased end of the spool valve. As described above, the relief valve assembly 48 is an adjustable direct spring valve such that valve member 92 will start to open when the force exerted by the pressure fluid entering inlet 90 exceeds the selected load set by the spring adjustment. Initially, pressure on each side of the orifice 110 will be equal since valve 48 will be closed and there will be no flow across the orifice. When the valve unseats, however, pressure fluid is dumped to drain through the relief valve, producing a flow through fixed orifice 110 which results in a reduced pressure $P_2$ on the downstream side of the orifice and the pressure to the spring biased end of the valve spool. As $P_1$ pressure increases, valve member 92 will move further from seat 94, permitting an increased flow through the valve 48 and producing an increased pressure drop across orifice 110 and consequently a greater pressure differential is applied to the pressure chamber at opposite ends of the valve spool.

As indicated above, fluid bled from the system through the pressure sensing relief valve 48 may be returned to the sump through an internal drain when the system is acting as an unloading valve, or through an external drain when the system is acting as a sequence valve providing pressure fluid to a power beyond circuit.

From the above, it is believed apparent that the pressure sensing relief valve may be manually adjusted to select the pressure at which it is desired to divert the secondary pump outlet from the primary outlet port. Before the pressure sensing relief valve opens, the equal pressure applied to both ends of the valve spool enables biasing spring 66 to shift spool 54 to direct all secondary pump output to the primary valve outlet. Once the pressure relief valve setting pressure is reached, further increases in system pressure will produce a progressively greater pressure sensing valve opening to bleed progressively more fluid from the downstream side of orifice 110 until spool 54 is shifted to divert all secondary pump output to the secondary outlet.

Again, it is believed apparent that the system will function in essentially the reverse manner upon a reduction in system pressure.

The system will also function in a combined flow sensing and pressure sensing mode simply by utilizing both the adjustable flow sensing orifice and the fixed orifice and pressure sensing relief valve in the same combination. In this embodiment, pressure drop across the adjustable flow sensing orifice will continuously provide a differential pressure to the two ends of the spool valve 54 as in the flow sensing only mode, and the system will function in exactly the same manner as in the flow sensing only mode until the $P_2$ pressure reaches the value set in the pressure sensing relief valve. Above this pressure, the pressure sensing relief valve will act to amplify the pressure differential on the two ends of the valve in the manner described with respect to the pressure sensing only mode, and movement of the spool valve will be accelerated. Adjustment to the pressure sensing relief valve and the adjustable flow sensing orifice enables an infinite number of combination settings, within pump operating limits, on a fixed displacement variable speed pump drive system.

Figure 15:
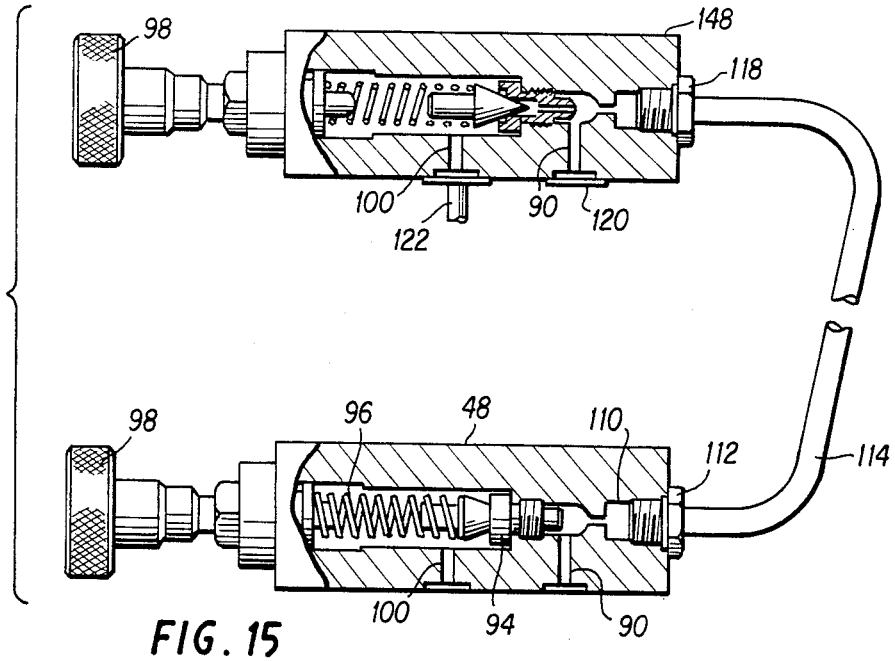
FIG. 15 is a fragmentary sectional view of a portion of the valve structure employed in combination with a remote relief valve.

Referring now to FIG. 15, it is seen that the unloading and sequencing valve assembly 14 of the present invention is readily adaptable to remote pressure control. To accomplish this, valve 48 is provided with a threaded opening 112 which communicates with an enlarged chamber in inlet 90, and a threaded fitting 114 connects one end of an elongated tubular conduit 116 in the outlet 112. Tube 116 has its other end connected by threaded fitting 118 to a remote pressure relief valve 148. Valve 148 preferably is substantially identical to valve 48 but has its inlet 90 closed as by plug 120 and its drain 100 connected to a drain conduit 122. The manually operable threaded pressure adjusting screw 98 of valve 148 enables selective adjustment of sensing pressure from a remote area such as in the operator's cab of a vehicle or at the operator's console of a stationary hydraulic system. The sensing pressure of valve 48 is set at a level higher than that to be selected at the remote sensing valve 148 so that unloading or sequencing of the main valve assembly 10 is controlled by valve 148. However, valve 48 will still act as a safety or relief valve by functioning in its normal manner in the event valve 148 is inadvertently set to unload valve assembly 10 at an excessively high pressure. Remote sensing as illustrated in FIG. 15 may be employed in the pressure sensing only mode or in the combined flow sensing and pressure sensing mode as described hereinabove.

FIG. 16 illustrates a modification which enables remote selection between multiple preset operating pressures for the pressure sensing relief valve control of the unloading and sequencing valve. In this arrangement, a selectively energizable solenoid actuated pressure sensing and relief valve 248 is mounted on housing 14 and has its inlet and outlet drains connected in series with those of valve 48. Valve 248 is preset to the lowest desired sequencing or unloading pressure while valve 48 is set at the highest desired sequencing or unloading pressure. It should also be pointed out that a plurality of valves 248 may be connected in parallel between valve body 14 and valve 48, with the pressure setting on successive valves 248 being progressively higher from valve body 14 of the valve 48.

Valve 248 is similar to valve 48 except that in valve 248 $P_2$ pressure is directed through inlet passage 124 to an inlet chamber 126 containing a solenoid actuated two-way valve assembly 128. Two-way valve 128 may be a normally opened or normally closed valve, with the position of the valve being controlled by a solenoid 130 which may be selectively actuated from a remote station to direct $P_2$ pressure either to chamber 132 to act on valve member 134 in the manner described above with respect to valve 48 or to direct $P_2$ pressure to an outlet port 136 communicating with inlet 90 of valve 48. As shown in FIG. 16, drain 100 of valve 48 communicates with a passage 138 which, in turn, communicates with drain 140 of valve 248.

In operation of the system employing multiple pressure sensing, the operator may selectively energize or deenergize solenoid 130 to direct $P_2$ pressure to the valve element 132 in valve 248 or to isolate valve member 132 and direct pressure to valve element 92 in valve 48. When low pressure unloading or sequencing is desired, valve 48 will thus be isolated and valve 248 will function in the same manner described above with regard to valve 48. Conversely, when a higher unloading or sequencing pressure is desired, solenoid 130 is actuated to direct $P_2$ pressure to inlet 90 and valve 48 will function to control the unloading or sequencing of valve assembly 10 while valve 248 remains isolated.

It is believed apparent, also, that a remote adjustable pressure sensing relief valve 148 could be employed to enable selective adjustment of the unloading pressure of valve 48 used in conjunction with one or more preset solenoid activated valves 248. Further, when a plurality of solenoid-actuated valve 248 are connected in parallel between valve body 14 and valve 48 to enable selection between a plurality of preset unloading or sequencing pressures, the solenoids of the respective valves 248 should be connected in a control circuit so that when a desired unloading pressure is selected by the operator, the solenoids of all valves 248 having a lower pressure setting will be activated to direct $P_2$ pressure fluid to the selected valve. The advantage to such multiple pressure sensing, remote control is that it allows many machine logic functions to be satisfied in installations where it is desired or required to sequence or unload hydraulic pump flow as a function of more than one preset pressure. By utilizing a plurality of adjustable pressure sensing modules employing the two-way solenoid valves, the capability of quickly switching between various preset unloading pressures is easily achieved, and of course remote adjustment of the upper pressure is available if desired.

Figure 17:
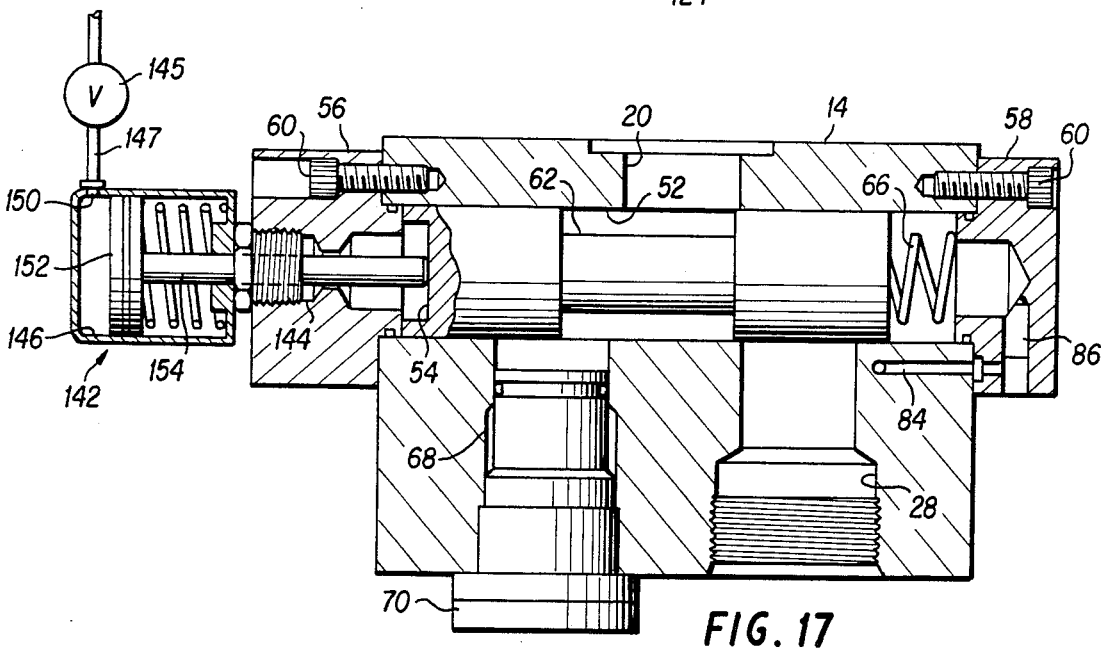
FIG. 17 is a fragmentary sectional view similar to FIG. 9 and showing an alternate embodiment of the invention.

Referring now to FIG. 17, an alternate embodiment of the invention is illustrated wherein a selectively operable pneumatic actuator 142 is mounted in a threaded bore 144 formed in and extending through the end cap 56. Actuator 142 includes a cylinder 146 having an air inlet 150 adjacent its closed end, and a piston 152 mounted on a rod 154 is slidably mounted in the cylinder with the free end of rod 154 in engagement with the end face of valve member 54. A suitable selectively operable valve 145 connected in line 147 may be actuated to direct air, under pressure, into the cylinder 146 to act upon piston 152 to apply a force, through rod 154 to the valve member 54 to shift the valve member against the force of spring 66 and $P_2$ pressure acting on the opposite end of the valve spool to quickly shift the valve to direct secondary pump output to the secondary outlet 28. It should be apparent, however, that in the absence of the application of pneumatic pressure to the air actuator 142, the valve assembly will function in the manner described hereinabove with regard to FIGS. 1–14. At the same time, if for any reason the operator deems it necessary or desirable to unload the pneumatic circuit, he can do so without regard to pump speed or pressure simply by energizing the air actuator in the manner described. It should also be apparent that this arrangement may be employed to assist $P_1$ pressure in shifting the valve member 54 by the application of air at relatively low pressure to the cylinder 146. Thus, this arrangement may be employed selectively to unload the system at a lower hydraulic pressure differential across the valve spool than would be required in the absence of the air pressure to cylinder 146.

In a further modification of the invention, the threaded adjusting assembly of pressure sensing relief valve 48 is replaced with a proportional solenoid having a plunger acting on the internal valve member 92 in a direction tending to seat the valve member against $P_2$ pressure applied to the valve. The proportional solenoid applies a plunger pressure varying directly with current applied to the coil, and unloading pressure can therefore be readily adjusted from any remote location by simply turning the knob of a potentiometer connected in the circuit of the proportional solenoid.

While various embodiments and modifications of the invention have been disclosed and described, it is believed apparent that other modifications might readily be made and it should therefore be understood that it is not intended to be restricted solely to the disclosed embodiments but rather it is intended to include all embodiments which would be apparent to one skilled in the art and which come within the spirit and scope of the invention.

What is claimed:

1. In a hydraulic system employing primary and secondary pumps for supplying fluid under pressure to a hydraulic circuit for use and control valve means connected to the primary and secondary pumps for controlling the flow of fluid to the hydraulic circuit, the improvement wherein said control valve means comprises, a valve housing having primary and secondary fluid inlets adapted to be connected to the primary and secondary pumps, respectively, to receive pressure fluid from the pumps, an elongated valve spool mounted for axial sliding movement in an elongated valve chamber in said housing, said valve spool having end walls cooperating with said valve chamber to define a fluid chamber at each end of said valve spool and a reduced diameter portion intermediate said end walls cooperating with said valve chamber tc define a movable secondary flow chamber in fluid communication with said secondary inlet, a primary flow channel in said housing connected with said primary inlet and terminating in a primary outlet, a removable flow sensing orifice assembly mounted in said housing, said orifice assembly including an adjustable orifice disposed in said primary flow channel for producing a pressure drop therein, a first pilot fluid pressure passage extending between said primary flow channel upstream of said adjustable orifice and one of said fluid chambers and a second pilot fluid pressure passage extending between said primary flow passage downstream of said adjustable flow orifice and the other said fluid chamber, first resilient means continuously biasing said valve spool toward said one fluid chamber, a secondary discharge channel having one end communicating with said movable secondary flow chamber and its other end defining a secondary outlet, a secondary fluid pressure passage extending between said movable secondary flow chamber and said primary fluid channel, and one-way check valve means mounted in said secondary fluid pressure passage and operable to prevent the flow of pressure fluid from said primary flow channel to said movable secondary flow chamber, said first resilient means and the pilot fluid pressure in said other fluid chamber continuously urging said valve spool toward said one fluid chamber to direct pressure fluid from said secondary pump through said movable secondary flow chamber and said secondary pressure passage to said primary flow channel, said valve spool being moved toward said other fluid chamber by pressure in said one fluid chamber to thereby direct fluid from said secondary pump through said movable secondary flow chamber to said secondary discharge channel when flow through said adjustable orifice produces a predetermined pressure drop across the orifice.

2. The invention defined in claim 1 further comprising first pressure relief valve means mounted on said housing and including a valve body having an inlet connected in said second pilot fluid pressure passage and a drain outlet, a valve seat between said inlet and said outlet, a movable valve member, and second resilient means normally urging said movable valve member into engagement with said valve seat to prevent the flow of fluid through said first pressure relief valve means below a predetermined pressure in said primary flow channel downstream of said adjustable orifice, said second resilient means permitting said first pressure relief valve means to open to bleed fluid from said second pilot fluid pressure passage above said predetermined pressure to thereby reduce the pilot fluid pressure applied to said other fluid chamber.

3. The invention defined in claim 2 wherein said first pressure relief valve means further comprises means operable to adjust the force exerted by said second resilient means on said movable valve member to thereby vary the pressure at which said first pressure relief valve means opens.

4. The invention defined in claim 3 wherein said second resilient means comprises a spring mounted within said valve body and engaging said movable valve member, and adjustable means for varying the force exerted by said spring on said valve member.

5. The invention defined in claim 2 wherein said control valve means comprises drain means including an internal drain channel formed in said housing, said drain channel having an open inlet in fluid communication with said drain outlet of said first pressure relief valve and an outlet end communicating with said secondary discharge channel to provide internal drainage for said first pressure relief valve when said control valve is operated as an unloading valve and said secondary discharge channel is not pressurized.

6. The invention defined in claim 5 further comprising means for closing said drain channel internally of said housing to prevent flow of fluid between said drain channel and said secondary discharge channel, and an external drain adapted to be connected in fluid communication with said internal drain channel to provide external drainage for said first pressure relief valve when said control valve is operated as a sequencing valve and said secondary discharge channel is pressurized.

7. The invention defined in claim 2 further comprising a fixed flow restricting orifice in said second pilot fluid pressure passage upstream of said first pressure relief valve means whereby, when said pressure relief valve is open to produce a fluid flow in said second pilot fluid pressure passage, a pressure drop is produced across said fixed orifice.

8. The invention defined in claim 7 wherein said first pressure relief valve means further comprises means operable to adjust the force exerted by said second resilient means on said movable valve member to thereby vary the pressure at which said first pressure relief valve means opens.

9. The invention defined in claim 8 wherein said second resilient means comprises a spring mounted within said valve body and engaging said movable valve member, and adjustable means for varying the force exerted by said spring on said valve member.

10. The invention defined in claim 9 wherein said control valve means comprises drain means including an internal drain channel formed in said housing, said drain channel having an open inlet in fluid communication with said drain outlet of said first pressure relief valve and an outlet end communicating with said secondary discharge channel to provide internal drainage for said first pressure relief valve when said control valve is operated as an unloading valve and said secondary discharge channel is not pressurized.

11. The invention defined in claim 10 further comprising means for closing said drain channel internally of said housing to prevent flow of fluid between said drain channel and said secondary discharge channel, and an external drain adapted to be connected in fluid communication with said internal drain channel to provide external drainage for said first pressure relief valve when said control valve is operated as a sequencing valve and said secondary discharge channel is pressurized.

12. The invention defined in claim 7 wherein said valve housing is adapted to be mounted directly onto the bearing carrier housing of a dual outlet pump assembly with said primary and secondary inlets in direct fluid communication one with each outlet of said pump assembly.

13. The invention defined in claim 10 further comprising at least one selectively operable pressure relief valve mounted between said housing and said first pressure relief valve, said at least one selectively operable pressure relier valve having an inlet and a drain outlet connected in parallel with the inlet and drain outlet, respectively of said first pressure relief valve means and each said selectively operable pressure relief valve having a two-way valve connected in its inlet, each said two-way valve being operable to selectively direct fluid pressure from said second pilot fluid pressure passage to the associated pressure relief valve or to the next successive pressure relief valve inlet, the opening pressure of said selectively operable pressure relief valves and said first pressure relief valve increasing progressively from the first said selectively operable pressure relief valve mounted on said housing to said first pressure relief valve.

14. The invention defined in claim 13 wherein each said selectively operable pressure relief valve comprises solenoid means operably connected to said two-way valve, each said solenoid means being selectively operable to control operation of the associated two-way valve.

15. The invention defined in claim 9 further comprising second pressure relief valve means including a valve body having an inlet connected in fluid communication with the inlet of said first pressure relief valve means and an outlet, said second pressure relief valve means being normally closed to prevent the flow of fluid therethrough and being opened by application of fluid pressure to its inlet, the pressure at which said second pressure relief valve means opens being less than the pressure at which said first pressure relief valve means opens.

16. The invention defined in claim 15 further comprising adjusting means operable to vary the pressure at which said second pressure relief valve means opens.

17. The invention defined in claim 2 further comprising a plunger mounted on said housing and extending into said one fluid chamber and engaging the end wall of said valve spool, said plunger being supported for axial sliding movement, and selectively operable means for applying a force to said plunger tending to move said valve spool in a direction to direct secondary pump output to said secondary discharge channel.

18. In a hydraulic system employing primary and secondary pumps for supplying fluid under pressure to a hydraulic circuit for use and control valve means connected to the primary and secondary pumps for controlling the flow of fluid to the hydraulic circuit, the improvement wherein said control valve means comprises, a valve housing having primary and secondary fluid inlets adapted to be connected to the outlets of the primary and secondary pumps, respectively, elongated valve chamber formed in said housing, an elongated valve spool mounted for axial sliding movement in said valve chamber, said valve spool having end walls cooperating with said valve chamber to define a pressure chamber at each end of said valve spool and a reduced diameter portion intermediate said end walls and cooperating with said valve chamber to define a movable secondary flow chamber in fluid communication with said secondary inlet, a primary flow channel in said valve body connected with said primary inlet and terminating in a primary outlet, a first pilot fluid passage extending between said primary flow channel and one of said pressure chambers and a second pilot fluid passage extending between said primary flow passage and the other of said pressure chambers, first pressure sensing relief valve means including a valve body having an inlet chamber connected in fluid communication with said second pilot fluid pressure passage, a drain outlet, a valve seat and a movable valve member between said inlet chamber and said drain outlet, and first resilient means normally urging said movable valve member into engagement with said valve seat to prevent the flow of fluid through the pressure relief valve means below a predetermined pressure in said primary flow channel, said first resilient means permitting said pressure relief valve means to open to bleed fluid from said second pilot fluid pressure passage through said drain outlet at pressures in said primary flow channel above said predetermined pressure, a fixed flow restricting orifice in said second pilot fluid pressure passage upstream of said pressure sensing relief valve, said fixed orifice producing a pressure differential thereacross when said pressure sensing relief valve is open to produce a flow through said second pilot fluid pressure passage, second resilient means continuously biasing said valve spool toward said one pressure chamber, a secondary flow channel in said housing having one end communicating with said movable secondary flow chamber and its other end defining a secondary outlet, a secondary fluid pressure passage extending between said movable secondary flow chamber and said primary flow channel, one-way check valve means disposed in said secondary fluid pressure passage operable to prevent the flow of pressure fluid from said primary flow channel to said movable secondary flow chamber, said second resilient means and the pressure of fluid in said other pressure chamber supplied from said second pilot fluid pressure passage continuously urging said valve spool toward said one pressure chamber to provide fluid communication between said movable secondary flow chamber and said primary flow passage through said secondary fluid pressure passage, said valve spool being moved toward said other pressure chamber to provide fluid communication between said movable secondary flow chamber and said secondary flow channel by pressure fluid directed through said first pilot flow passage when the pressure in said one pressure chamber exceeds the pressure in said other pressure chamber by a predetermined amount.

19. The invention defined in claim 18 wherein said valve housing is adapted to be mounted directly onto the bearing carrier housing of a dual outlet pump assembly with said primary and secondary inlets in direct fluid communication one with each outlet of said pump assembly.

20. The invention defined in claim 18 wherein said first pressure sensing relief valve means further comprises means operable to adjust the force exerted by said first resilient means on said movable valve member to thereby vary the pressure at which said first pressure sensing relief valve means opens.

21. The invention defined in claim 20 wherein said first resilient means comprises a spring mounted within said valve body and engaging said movable valve member, and adjustable means for varying the force exerted by said spring on said valve member

22. The invention defined in claim 21 wherein said control valve means comprises drain means including an internal drain channel formed in said housing, said drain channel having an open inlet in fluid communication with said drain outlet of said first pressure sensing relief valve means and an outlet end communicating with said secondary discharge channel to provide internal drainage for said first pressure sensing relief valve means when said control valve is operated as an unloading valve and said secondary discharge channel is not pressurized.

23. The invention defined in claim 22 further comprising means for closing said drain channel internally of said housing to prevent flow of fluid between said drain channel and said secondary discharge channel, and an external drain adapted to be connected in fluid communication with said internal drain channel to provide external drainage for said first pressure sensing relief valve means when said control valve is operated as a sequencing valve and said secondary discharge channel is pressurized.

24. The invention defined in claim 21 further comprising at least one selectively operable pressure sensing relief valve mounted between said housing and said first pressure sensing relief valve means, said at least one selectively operable pressure relief valve having an inlet and a drain outlet connected in parallel with the inlet and drain outlet, respectively of said first pressure relief valve means, each said selectively operable pressure sensing relief valve having a two-way valve connected in its inlet, each said two-way valve being operable to selectively direct fluid pressure from said second pilot fluid pressure passage to the associated pressure relief valve or to the next successive pressure sensing relief valve inlet, the opening pressure of said selectively operable pressure sensing relief valve means and said first pressure sensing relief valve means increasing progressively from the first said selectively operable pressure sensing relief valve mounted on said housing to said first pressure sensing relief valve.

25. The invention defined in claim 24 wherein each said selectively operable pressure sensing relief valve means comprises solenoid means operably connected to said two-way valve, each said solenoid means being selectively operable to control operation of the associated two-way valve.

26. The invention defined in claim 21 further comprising second pressure sensing relief valve means including a valve body having an inlet connected in fluid communication with the inlet of said first pressure sensing relief valve means and a drain outlet, said second pressure sensing relief valve means being normally closed to prevent the flow of fluid therethrough and being opened by application of fluid pressure to its inlet, the pressure at which said second pressure sensing relief valve means opens being less than the pressure at which said first pressure sensing relief valve means opens.

27. The invention defined in claim 26 further comprising adjusting means operable to vary the pressure at which said second pressure sensing relief valve means opens.

28. The invention defined in claim 27 wherein said valve housing is adapted to be mounted directly onto the bearing carrier housing of a dual outlet pump assembly with said primary and secondary inlets in direct fluid communication one with each outlet of said pump assembly.

29. The invention defined in claim 28 wherein said control valve means comprises drain means including an internal drain channel formed in said housing, said drain channel having an open inlet in fluid communication with said drain outlet of said first pressure sensing relief valve means and an outlet end communicating with said secondary discharge channel to provide internal drainage for said first pressure sensing relief valve means when said control valve is operated as an unloading valve and said secondary discharge channel is not pressurized.

30. The invention defined in claim 29 further comprising means for closing said drain channel internally of said housing to prevent flow of fluid between said drain channel and said secondary discharge channel, and an external drain adapted to be connected in fluid communication with said internal drain channel to provide external drainage for said first pressure sensing relief valve means when said control valve is operated as a sequencing valve and said secondary discharge channel is pressurized.

31. The invention defined in claim 18 further comprising a plunger mounted on said housing and extending into said one pressure chamber and engaging the end wall of said valve spool, said plunger being supported for axial sliding movement, and selectively operable means for applying a force to said plunger tending to move said valve spool in a direction to direct secondary pump output to said secondary fluid pressure passage.

* * * * *